United States Patent [19]

Hill

[11] Patent Number: 4,473,117

[45] Date of Patent: Sep. 25, 1984

[54] METHOD AND APPARATUS FOR OBTAINING PRODUCTION OR INJECTION PROFILES

[75] Inventor: Alfred D. Hill, Austin, Tex.

[73] Assignee: Marathon Oil Company, Findlay, Ohio

[21] Appl. No.: 453,440

[22] Filed: Dec. 27, 1982

[51] Int. Cl.[3] ..... E21B 49/00

[52] U.S. Cl. ..... 166/252; 166/64

[58] Field of Search ..... 166/305 R, 250, 252, 166/255, 113, 64; 73/155; 367/33, 911, 912; 181/108

[56] References Cited

U.S. PATENT DOCUMENTS 2,453,456 11/1948 Piety ..... 166/250 X 3,193,004 7/1965 Albright ..... 166/252

3,965,983 6/1976 Watson ..... 166/250

*Primary Examiner*—Ernest R. Purser

*Assistant Examiner*—Timothy David Hovis

*Attorney, Agent, or Firm*—Jack L. Hummel; Rodney F. Brown

[57] ABSTRACT

The fluid flow profile in an underground reservoir having a well borehole is determined by placing in the well borehole an instrument capable of detecting the velocity of an interface moving in the well borehole. The well is shut-in to allow oil and water to separate and form an interface. A fluid miscible with the oil and less dense than the water is injected into the well borehole and forces the interface to move down the well borehole. The fluid flow profile is determined by analyzing the data obtained from the instrument.

15 Claims, 2 Drawing Figures

METHOD AND APPARATUS FOR OBTAINING PRODUCTION OR INJECTION PROFILES

FIELD OF INVENTION

This invention relates to the determination of the production or injection profile, which is the fluid flow profile, in an underground reservoir and more particularly to the determination of the fluid flow profile in an underground reservoir by utilizing the velocity of an interface moving within the well borehole.

BACKGROUND OF THE INVENTION

Throughout the years, there have been many different proposals for determining the fluid flow profile in an underground reservoir. Many of these proposals relate to the use of tracer products which are injected by various methods into the well borehole. The paths of these tracer products are resolved in many different ways to determine the characteristics of the fluid flow in the underground reservoir. These proposals require many different operations including the use of special instruments and/or the backflow of fluid. Thus, there is need for a method for determining the fluid flow profile in an underground reservoir that is relatively easy to perform, gives reliable results and is economical.

It is an object of this invention to provide a method for determining the production profile in an underground reservoir.

It is another object of this invention to provide a method for determining the injection profile in an underground reservoir.

It is a further object of this invention to utilize a moving interface to determine the production or injection profile in an underground reservoir.

BRIEF SUMMARY OF THE INVENTION

The foregoing objects of this invention, in relation to a production profile, are accomplished by positioning an instrument in a well borehole which instrument is capable of detecting the velocity of an oil-water interface in the well borehole. The well is shut in to allow the oil and water to separate and form an interface between the oil and water. Preferably, this interface in formed in the tubing string in the well borehole. A hydrocarbon liquid, having a density less than the produced water and miscible with the produced oil, is injected into the well. In one embodiment, the hydrocarbon liquid is diesel. However, other hydrocarbon liquids such as native crude oil and kerosene may be used. The injected hydrocarbon liquid causes the interface to move down through the tubing string and into the well borehole below the tubing string where it continues to move downwardly. The instrument measures the location of the interface as a function of time during the injection of the hydrocarbon liquid. A numerical model is obtained and used to provide a production profile of the well. It should be noted that most of the hydrocarbon liquid can be recovered when the well resumes production. A slightly different method for obtaining an injection well profile is performed. Since it is not desirable to inject a hydrocarbon liquid in this operation, a brine having a density less than the initial fluid is used to maintain a competent interface.

BRIEF DESCRIPTION OF THE DRAWINGS

The foregoing and other objects, features, and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

DETAILED DESCRIPTION OF THE PREFERRED EMBODIMENT

Figure 1:
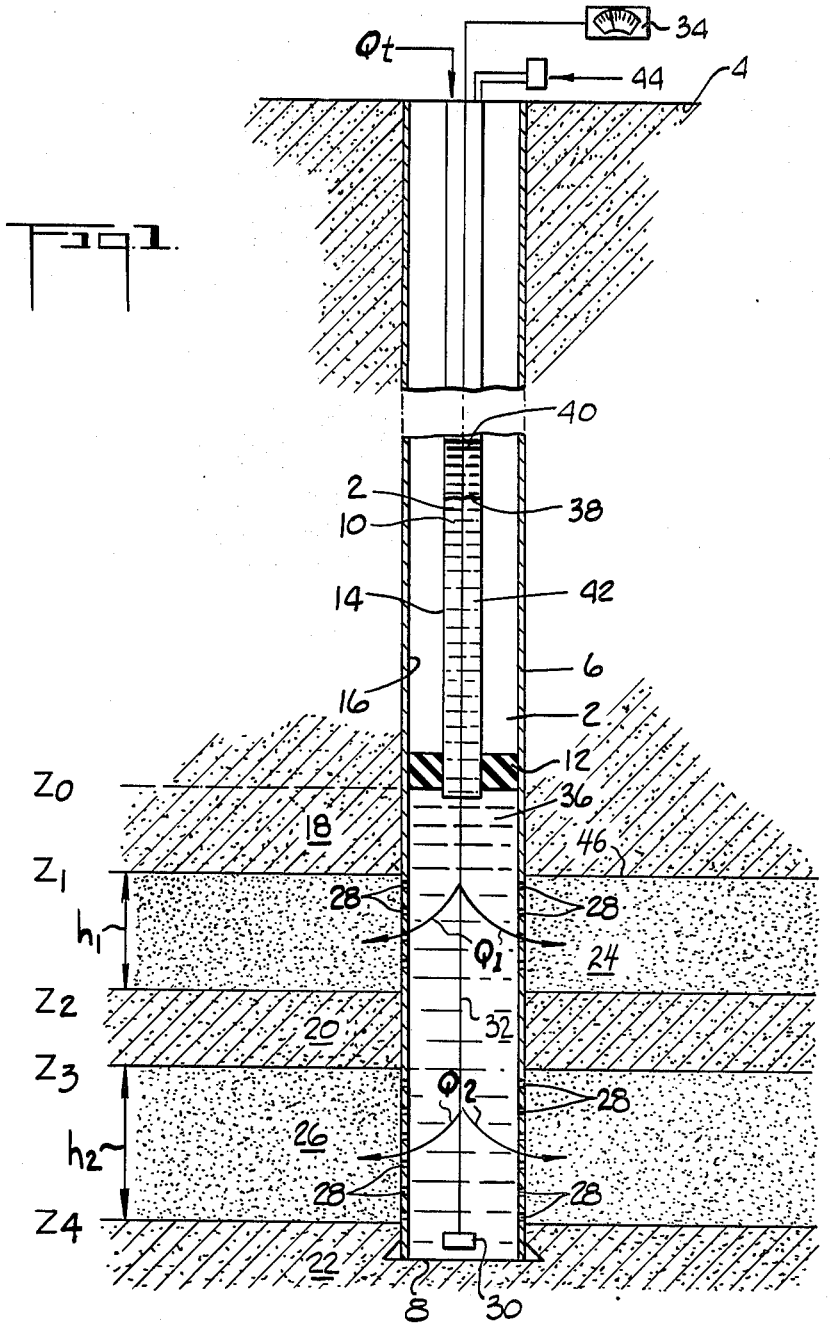
FIG. 1 is an illustration of an underground reservoir.

In FIG. 1, there is illustrated a well borehole 2 extending below the ground surface 4. A casing 6 extends through the well borehole 2 from the surface 4 to the bottom 8 of the well borehole. Located within the casing 6 is a tubing string 10 with a packer 12 located adjacent the bottom of the tubing string 10. The packer 12 forms a seal between the outer surface 14 of the tubing string 10 and the inner surface 16 of the casing 6 so that the flow of fluid into and out of the underground reservoir occurs only through the tubing string 10.

The well borehole 2 traverses several subsurface formations or layers such as non-fluid containing layers 18, 20 and 22 and fluid containing layers 24 and 26. The casing 6 has perforations 28 in the portions adjacent layers 24 and 26 to permit flow of fluids out of the casing 6 into layers 24 and 26 and out of layers 24 and 26 into the casing 6.

An instrument 30, capable of measuring the velocity of an interface moving in the well borehole, is positioned in the casing 6 below the fluid containing layer 26 adjacent the non-fluid containing layer 22. The instrument measures velocity since it is capable of detecting the location of the interface moving in the well borehole as a function of time. Means 32 extending from the instrument 30 to a decoding device 34 transmits the output from the instrument 30 to the decoding device 34 from which useful information is obtained.

The well is shut in and after a period of time, the fluids in the tubing string 10 and the portion 36 of the casing 6 below the packer 12 will separate and form an interface 38. In the preferred embodiment, oil 40 will be above the interface 38 and water 42 will be below the interface 38. Means 44 located above the surface 4 are provided for injecting a fluid into the tubing 10. In the preferred embodiment, the fluid injected into the tubing is a hydrocarbon liquid which is miscible with the oil 40 and has a density less than the water 42. Suitable hydrocarbon liquids include native crude oil, diesel and kerosene and in the embodiment described herein the hydrocarbon liquid is diesel.

An example of this invention will be explained in relation to the well shown in FIG. 1. It is assumed that the well is producing fluid in a ratio of 50% oil and 50% water. After the shut in of the well, we will assume that the fluid in the tubing 10 and the portion 36 of the casing 6 will be in the ratio of 30% oil and 70% water because of the difference in density between the oil and water. For purposes of this explanation, it is further assumed that the tubing string 10 has a capacity of 80 bbls and the portion 36 of the casing 6 has a capacity of 20 bbls, so that 30 bbls of oil and 70 bbls of water will be present. When the oil and water separate to form the interface 38, the tubing string 10 will contain 30 bbls of oil 38 and 50 bbls of water 42. The interface 38 is formed $\frac{3}{8}$ of the distance down the tubing string 10. It is also assumed that the well has surface pressure when shut in.

Liquid diesel is injected into the tubing 10 by the means 44 to force the oil-water interface 38 down the tubing string 10. The rate at which the liquid diesel is injected is not important to the method of this invention, but it is preferred that a fairly slow injection rate, such as a rate of about 1000 bbls a day, be used so as to minimize turbulence at the interface 38. However, since we are concerned with the velocity of the interface 38, it is important to maintain a constant injection rate. After 50 bbls of liquid diesel have been injected, the interface 38 will be at the lower end of the tubing string 10. Continued injection of diesel will force the interface 38 down into the portion 36 of the casing 6 until the interface 38 is below the lowest fluid containing layer 26 which in this example would require the injection of an additional 40 bbls of liquid diesel so that 90 bbls of liquid diesel would be utilized.

As soon as the interface 38 reaches a point 46 where horizontal flow of water 42 from the casing 6 through perforations 28 into layer 24 occur, the velocity of the interface 38 begins to slow. The instrument 30 is monitoring the velocity of the interface 38 and its output will be a plot of the interface velocity versus depth of the interface 38 in the tubing string 10 or the portion 36 of the casing 6.

To illustrate how the data are analyzed to give a fluid flow profile in the well, it is assumed that the movement of the interface 38 in the tubing string 10 and the portion 36 of the casing 6 is a steady piston-like displacement but with some changes in velocity. Also, it is assumed that the flow rates $Q_1$ and $Q_2$ into the layers 24 and 26 are evenly distributed through the layers. Thus, the flow rate into any one-foot interval in layer 24 is $Q_1/h_1$, where $h_1$ is the thickness of layer 24. Making these assumptions, the velocity of the interface at any point will be defined by the following equations:

$$\text{For } z_0 < z < z_1 \qquad V_{interface} = \frac{Q_T}{A}$$

$$\text{For } z_1 < z < z_2 \qquad V_{interface} = \frac{Q_T - Q_1\left(\frac{z - z_1}{h_1}\right)}{A}$$

$$\text{For } z_2 < z < z_3 \qquad V_{interface} = \frac{Q_T - Q_1}{A}$$

$$\text{For } z_3 < z < z_4 \qquad V_{interface} = \frac{Q_T - Q_1 - Q_2\left(\frac{z - z_3}{h_2}\right)}{A}$$

where $V_{interface}$=velocity of interface

Figure 2:
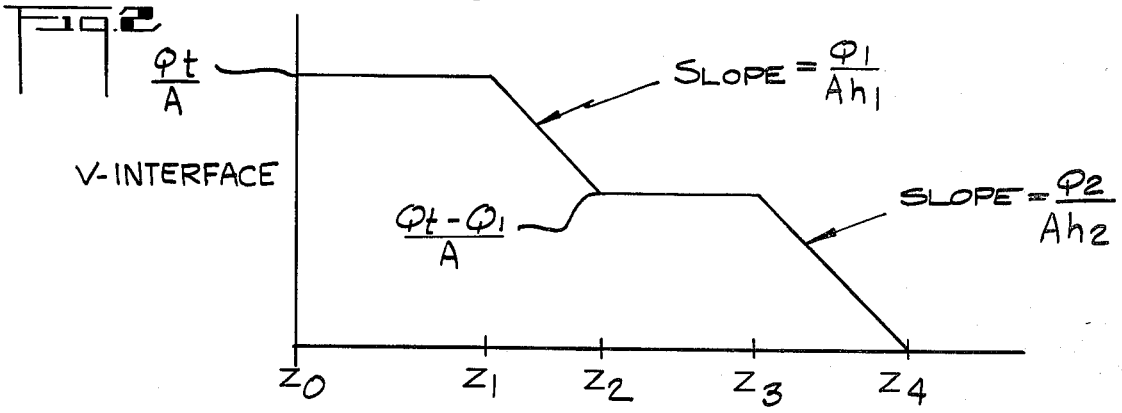
FIG. 2 is a graph of the output from the measuring device.

A=cross-sectional area of wellbore $Q_T$=injection rate into well $Q_1$, $Q_2$=flow rates into Layers 1 and 2 z=depth of the interface below the surface $z_0$, $z_1$, $z_2$, $z_3$, $z_4$=depth below the surface h=layer thickness In FIG. 2, there is a plot of the velocity of the interface versus its depth in the tubing string 10 or portion 36 of the casing 6. It is evident that the flow rates $Q_1$ and $Q_2$ into the layers 24 and 26 can be obtained from these data.

The instrument 30 can be any device capable of measuring the location of the oil-water interface as a function of time. One such device is a sonar type ultrasonic device that would direct ultrasonic waves to the interface and measure the travel time of the reflected signal. Another possible measuring technique would be a conductivity probe that is the length of the well borehole 2. Since the conductivity of oil is much less than that of water, such a probe would indicate the fraction of the well borehole containing oil as a function of time and thus indicate the velocity of the interface. Another possibility is an optic device that would measure a beam of light reflected by the interface.

The method of this invention is also applicable to an injection well profile where it is desirable to know the flow rates into the layers 24 and 26. Preferably, a brine having a density less than the initial fluid in the well borehole is used to form an interface. The injected brine also contains a substance which can be detected by the instrument used to measure the velocity of the interface. However, the brine can have a density equal to the initial fluid in the well borehole provided that an interface is formed and maintained throughout the operation. Many substances can be used to measure the velocity of the interface. For example, if a sonar type of detector is used, gas bubbles can be entrained in the injected brine to reflect the signal. Instead of gas bubbles, solid particles could be used to reflect the signal.

What is claimed is:

1. A method for determining the fluid flow profile in an underground reservoir, containing a first fluid and a second fluid capable of forming an interface, through the utilization of a well borehole occupied by said first and second fluids, the method comprising:

(a) positioning an instrument in said well borehole, said instrument being capable of detecting the velocity of an interface moving in said well borehole;

(b) shutting in said well borehole to allow said first and second fluids to separate and form an interface in said well borehole, the borehole axis passing through said interface, said first fluid above said interface and said second fluid below said interface;

(c) injecting a third fluid into said well borehole, said third fluid miscible with said first fluid and said third fluid less dense than said second fluid, to force said interface to move substantially downward in said well borehole; and (d) determining the fluid flow profile by analyzing the data obtained from said instrument.

2. A method as in claim 1 wherein:

(a) said first fluid above said interface comprises oil; and, (b) said second fluid below said interface comprises water.

3. A method as in claim 2 wherein:

(a) said injected third fluid comprises a hydrocarbon liquid.

4. A method as in claim 3 wherein:

(a) said hydrocarbon liquid is taken from a group comprising native crude oil, diesel and kerosene.

5. A method as in claim 3 wherein:

(a) said hydrocarbon liquid comprises diesel.

6. A method for determining the fluid flow profile in an underground reservoir through the utilization of a well borehole comprising:

(a) positioning an instrument below a plurality of layers in said underground reservoir with each of said layers in fluid communication with said well borehole, said instrument being capable of detecting the velocity of an interface moving in said well borehole;

(b) shutting in said well borehole to allow fluids in said well borehole to separate and form an interface;

(c) injecting a fluid into said well borehole which fluid is miscible with the fluid above said interface and is less dense than the fluid below said interface to force the interface to move down said well borehole; and (d) determining the fluid flow profile from said well borehole into each of said layers by analyzing the data obtained from said instrument.

7. A method as in claim 6 wherein:

(a) each of said layers contains oil and water.

8. A method as in claim 7 wherein:

(a) said fluid above said interface comprises oil; and, (b) said fluid below said interface comprises water.

9. A method as in claim 8 wherein:

(a) said injected fluid is a liquid hydrocarbon.

10. A method as in claim 9 wherein:

(a) said hydrocarbon liquid is taken from a group comprising native crude oil, diesel and kerosene.

11. A method as in claim 9 wherein:

(a) said hydrocarbon liquid comprises diesel.

12. A method for determining the fluid flow profile in an underground reservoir through the utilization of a well borehole comprising:

(a) positioning an instrument in a well borehole, said instrument being capable of detecting the velocity of an interface moving in said well borehole;

(b) stopping the normal operation of said well borehole to form an initial fluid in said well borehole;

(c) injecting a fluid into said well borehole, said injected fluid having characteristics capable of forming an interface between said initial fluid and said injected fluid;

(d) said injected fluid having added thereto a substance which is entrained in said fluid as discrete particles and which can be detected by said instrument;

(e) continuously injecting fluid into said well borehole to force said interface to move down said well borehole; and (f) determining the fluid flow profile by analyzing the data obtained from said instrument.

13. A method as in claim 12 wherein:

(a) said injected fluid has a density less than said initial fluid to form said interface.

14. A method as in claim 12 wherein:

(a) said injected fluid is a brine;

(b) said instrument is a sonar type of detector; and (c) said substance comprises air bubbles entrained in said injected fluid.

15. A method as in claim 12 and further comprising:

(a) positioning said instrument below a plurality of layers in said underground reservoir in fluid communication with said well borehole; and (b) determining the fluid flow profile from said borehole into each of these layers by analyzing the data obtained from said instrument.

* * * * *